US006325673B1

(12) United States Patent
Mai

(10) Patent No.: US 6,325,673 B1
(45) Date of Patent: Dec. 4, 2001

(54) ELECTRIC PLUG FOR AN EXTENSION CABLE

(76) Inventor: Chao-Lin Mai, No. 1, Alley 2, Lane 94, Po Ai Rd., Hsinchu City (TW)

( * ) Notice: Subject to any disclaimer, the term of this patent is extended or adjusted under 35 U.S.C. 154(b) by 0 days.

(21) Appl. No.: 09/634,578

(22) Filed: Aug. 8, 2000

(51) Int. Cl.[7] ..... H01R 13/68
(52) U.S. Cl. ..... 439/622
(58) Field of Search ..... 439/622, 621; 337/255, 198

(56) References Cited

U.S. PATENT DOCUMENTS 5,894,258 * 4/1999 Chang ..... 439/622
5,938,477 * 8/1999 Yen ..... 439/622
5,984,730 * 4/1999 Lu ..... 439/622

* cited by examiner

*Primary Examiner*—Gary F. Paumen
(74) *Attorney, Agent, or Firm*—Varndell & Varndell, PLLC

(57) ABSTRACT

An electric plug includes a hollow housing, a blade holder shell fitted into the housing to hold two electric wires and two metal blade, and a fuse connected between one electric wire and one metal blade, wherein the housing has a front opening and a rear opening respectively disposed through front and rear side walls thereof; the blade holder shell has a vertical rear side wall press-fitted into the rear opening of the housing, and a front protruding block fitted into the front opening of the housing to hold down the metal blades, keeping the metal blades squeezed in between two side walls of the front opening of the housing and two opposite lateral sides of the protruding block of the blade holder shell; one electric wire has a metal conductor clamp fixedly mounted on one end thereof and hooked in a retaining hole on one metal blade.

4 Claims, 4 Drawing Sheets

ELECTRIC PLUG FOR AN EXTENSION CABLE

BACKGROUND AND SUMMARY OF THE INVENTION

The present invention relates to electric plugs for extension cables or the like, and more particularly to such an electric plug, which is easy to assemble, and durable in use.

A variety of electric plugs have been disclosed for use with an extension cable for electric home appliances and computers. FIG. 1 illustrates an electric plug according to the prior art. This structure of electric plug comprises a hollow housing, a blade holder shell fitted into the housing, the housing having a locating hole on the front side wall thereof in the middle and two insertion holes spaced from the locating hole at two opposite lateral sides, two electric wire respectively installed in the housing, two metal blades respectively mounted in the blade holder shell and connected to the electric wires and extended out of the insertion holes on the front side wall of the housing, and a cartridge fuse connected between one electric wire and one metal blade. One electric wire is connected to the corresponding metal blade by welding. This structure of electric plug has drawbacks. One drawback of this structure of electric plug is its complicated assembly procedure. Another drawback of this structure is the application of welding to fasten one electric wire to the corresponding metal blade. During welding, a toxic gas will be produced, causing air pollution. Further, in order to hold the metal blades firmly in the insertion holes on the front side wall of the housing, the size of the insertion holes must not greater than the metal blades. Because the size of the insertion holes is not greater than the metal blades, it is not easy to accurately insert the metal blades through the insertion holes when inserting the blade holder shell into the housing, and the metal blades tend to be deformed during the assembly process of the electric plug.

The invention has been accomplished to provide an electric plug, which eliminates the aforesaid drawbacks. According to one aspect of the present invention, the electric plug comprises a hollow housing having a front opening and a rear opening, and a blade holder shell fitted into the housing to hold two electric wires and two metal blade, a fuse connected between one electric wire and one metal blade, wherein the blade holder shell has a vertical rear side wall press-fitted into the rear opening of the housing, and a front protruding block fitted into the front opening of the housing to hold down the metal blades, keeping the metal blades squeezed in between two side walls of the front opening of the housing and two opposite lateral sides of the protruding block of the blade holder shell. According to another aspect of the present invention, one electric wire has a metal conductor clamp fixedly mounted on one end thereof and hooked in a retaining hole on the corresponding metal blade.

DETAILED DESCRIPTION OF THE PREFERRED EMBODIMENT

Figure 1:
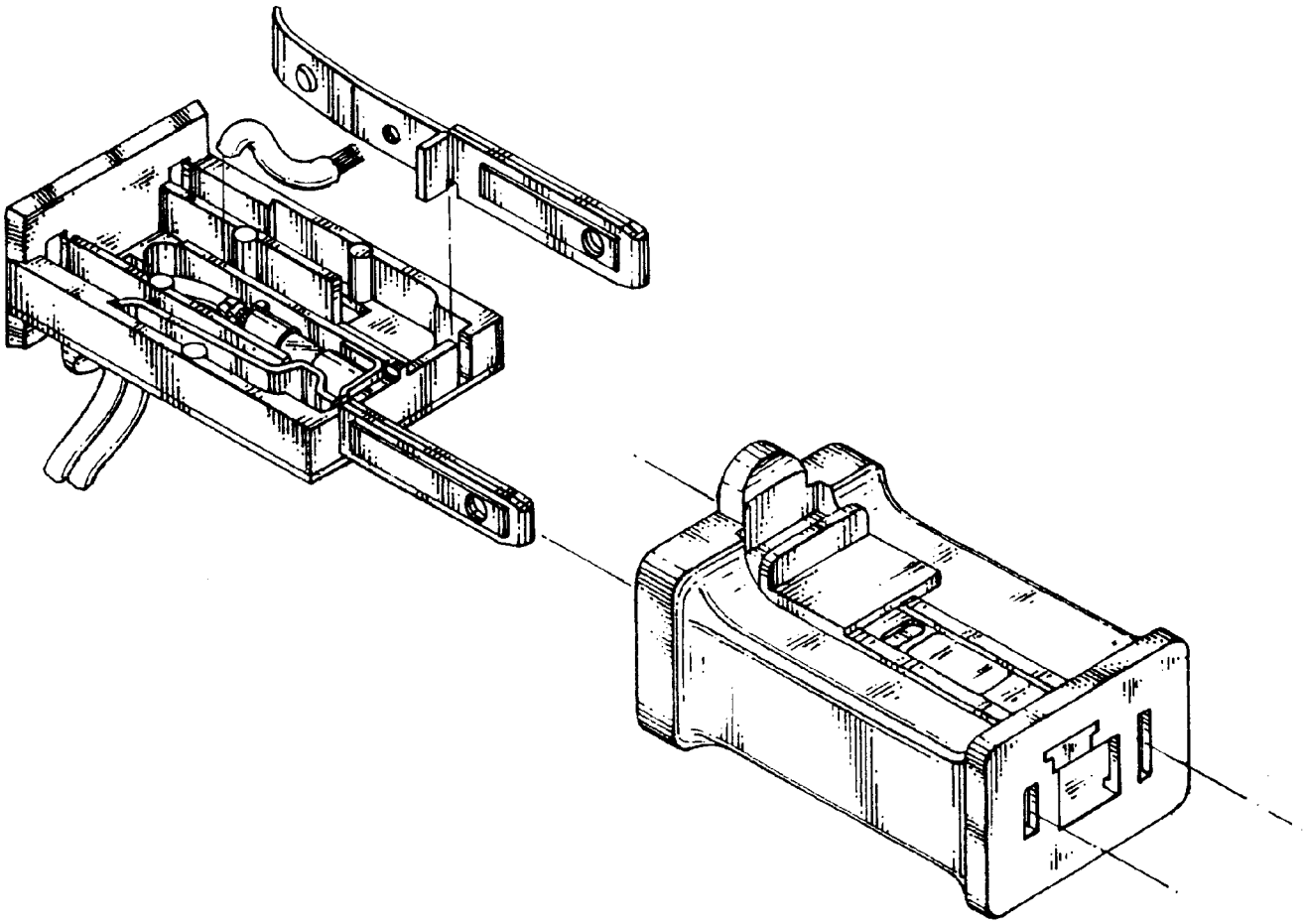
Fig. 1 PRIOR ART
FIG. 1 is an exploded view of an electric plug according to the prior art.
Figure 2:
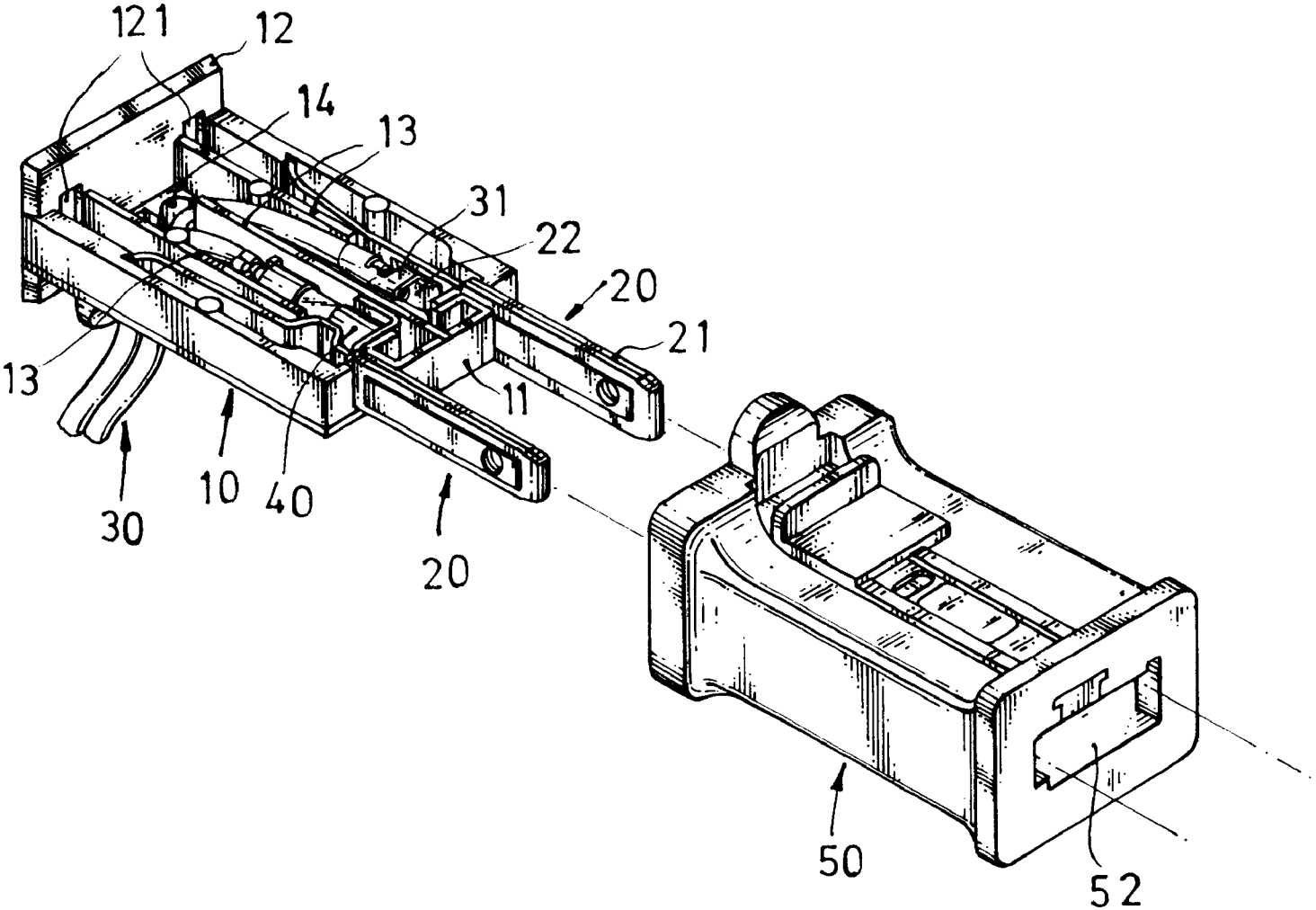
FIG. 2 is an exploded view of an electric plug according to the present invention.
Figure 3:
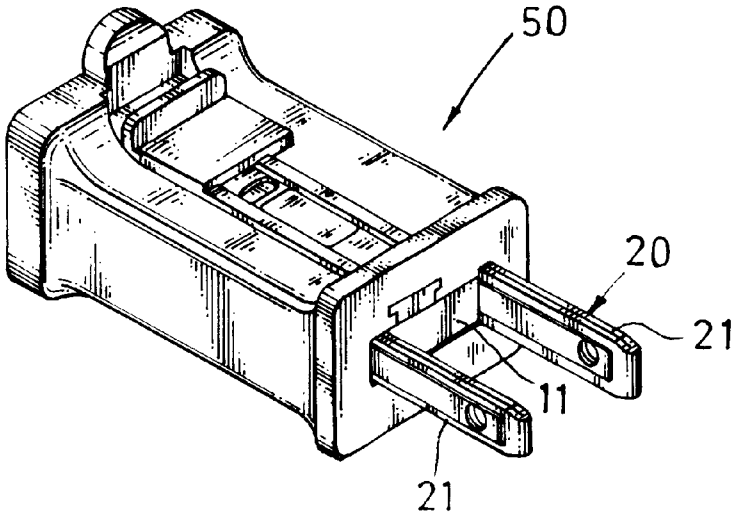
FIG.3 is an elevational view of the electric plug according to the present invention.

Referring to FIGS. 2 and 3, an electric plug in accordance with the present invention is generally comprised of a blade holder shell 10, two electrically conductive blades 20, two electric wires (a hot wire and a neutral wire) 30, a cartridge fuse 40, and a housing 50.

Figure 4:
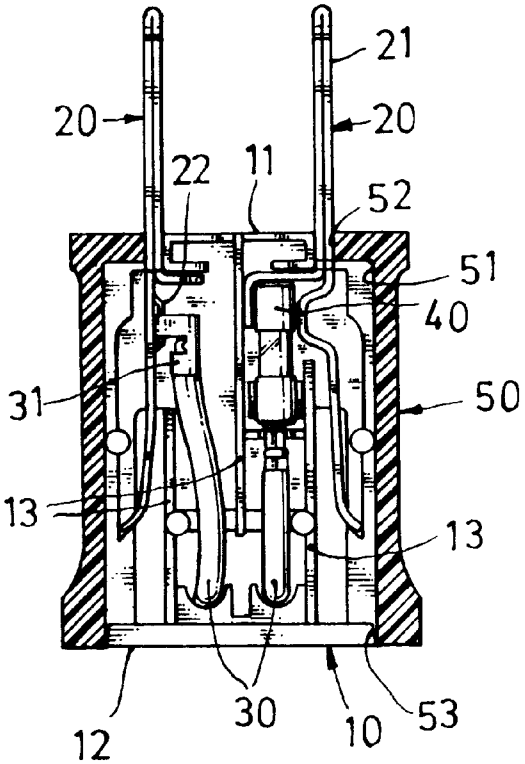
FIG. 4 is a sectional view of the electric plug according to the present invention.
Figure 5:
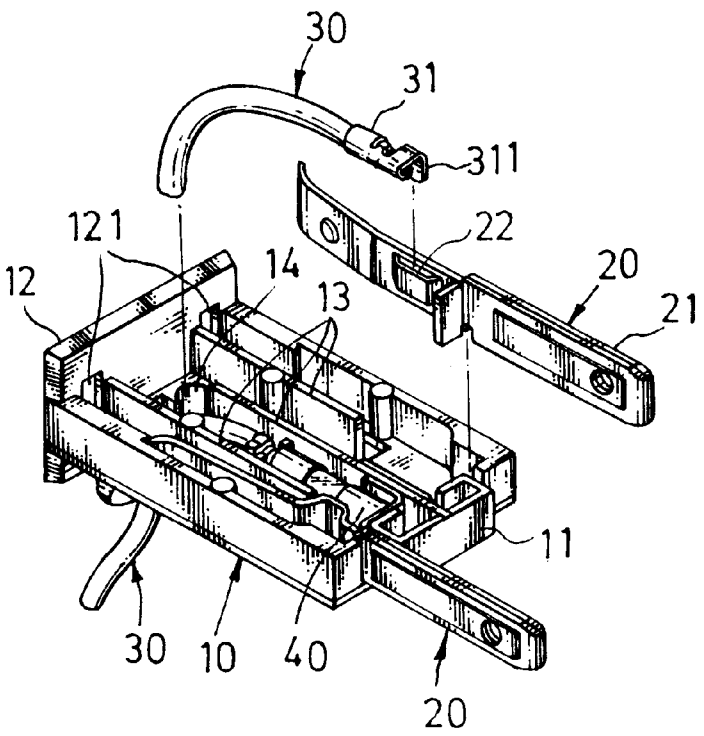
FIG. 5 is another exploded view of the present invention, showing one design of the metal blades.

Referring to FIGS. 4 and 5 and FIGS. 2 and 3 again, the blade holder shell 10 comprises a front protruding block 11, a vertical rear side wall 12, two locating holes 121 on the vertical rear side wall 12, a plurality of longitudinal partition walls 13 longitudinally disposed on the inside and defining a plurality of longitudinal receiving chambers adapted to receive the electrically conductive blades 20, and a wire hole 14 disposed near the vertical rear side wall 12 for the passing of the electric wires 30. The electrically conductive blades 20 are long, narrow copper plates respectively installed in the receiving chambers at two sides within the blade holder shell 10 and fastened to the locating holes 121 on the vertical rear side wall 12 of the blade holder shell 10, each having a front plug portion 21 protruded over the front side of the front protruding block 11 of the blade holder shell 10 and adapted for inserting into an electric outlet. One electrically conductive blade 20 has a retaining hole 22 on the middle. The electric wires 30 are respectively inserted through the wire hole 14 into the inside of the blade holder shell 10. One electric wire 30 has a metal conductor clamp 31 fixedly mounted on the conductors thereof at one end. The metal conductor clamp 31 has a hooked portion 311. The hooked portion 311 of the metal conductor clamp 31 is fastened to the retaining hole 22 of one electrically conductive blade 20. The other electric wire 30 is connected to one end of the fuse 40. The fuse 40 is installed in the blade holder shell 10, and connected between one electric wire 20 and one electrically conductive blade 30. The housing 50 comprises a receiving chamber 51 adapted to receive the blade holder shell 10, a front opening 52 on the front side wall thereof in communication with the receiving chamber 51, and a rear opening 53 on the rear side wall thereof in communication with the receiving chamber 51. The blade holder shell 10 is inserted from the rear opening 53 into the receiving chamber 51 to force the front protruding block 11 and the electrically conductive blades 20 into the front opening 52, enabling the plug portion 21 of each of the electrically conductive blades 20 to be respectively extended out of the front opening 52. After installation of the blade holder shell 10 in the housing 50, the electrically conductive blades 20 are positively retained between two opposite side walls of the front opening 52 of the housing 50 and two opposite lateral sides of the front protruding block 11 of the blade holder shell 10, and the front side wall of the front protruding block 11 of the blade holder shell 10 is disposed in flush with the front side wall of the housing 50.

Figure 6:
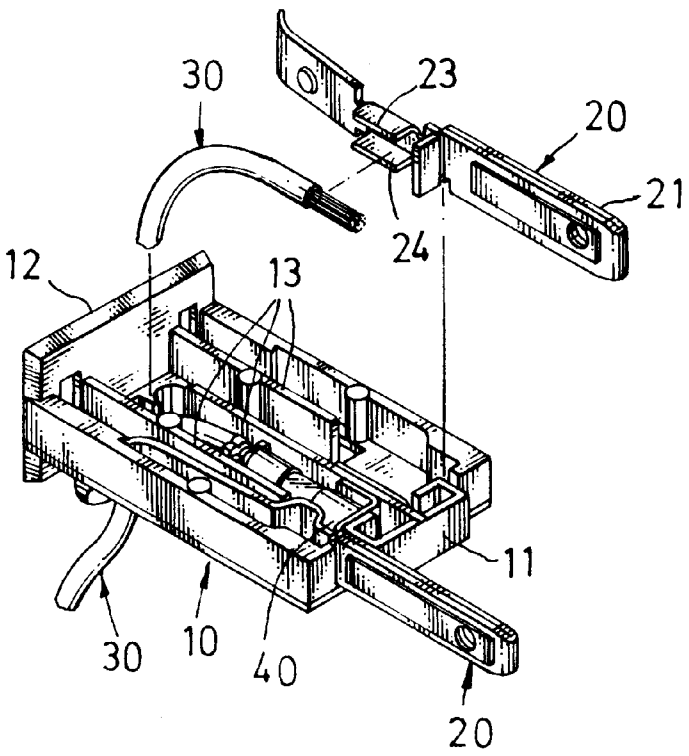
FIG. 6 is still another exploded view of the present invention, showing another design of the metal blades.

FIG. 6 shows an alternate form of the electrically conductive blade 20. According to this alternate form, the electrically conductive blade 20 comprises two parallel lugs 23 integral with a middle part thereof and defining a space 24. The conductors of one electric wire 30 are inserted into the space 24 between the lugs 23, and then the lugs 23 are deformed to hold down the conductors of the electric wire 30, and therefore the electric wire 20 is fixedly secured to the electrically conductive blade 20.

It is to be understood that the drawings are designed for purposes of illustration only, and are not intended for use as a definition of the limits and scope of the invention disclosed.

What is claimed is:

1. An electric plug comprising a housing having a receiving chamber, a blade holder shell mounted in the receiving chamber of said housing, two metal blades mounted in said blade holder shell and respectively extending out of said housing for connection to an electric outlet, two electric wires respectively connected to said metal blades, and a fuse installed in said blade holder shell inside said housing and connected between one of said metal blades and one of said electric wires, wherein said housing has a front opening and a rear opening respectively disposed through front and rear walls thereof in communication with said receiving chamber; said blade holder shell comprises a vertical rear wall press-fitted into the rear opening of said housing and disposed flush with the rear wall of said housing, and a front protruding block fitted into the front opening of said housing to hold down said metal blades, keeping said metal blades squeezed in between two side walls of the front opening of said housing and two opposite lateral sides of the protruding block of said blade holder shell; one of said electric wires has a metal conductor clamp fixedly mounted on one end thereof and fastened to one of said metal blades.

2. The electric plug of claim 1 wherein said front protruding block of said blade holder shell is disposed flush with the front wall of said housing.

3. The electric plug of claim 1 wherein one of said metal blades comprises a retaining hole in the middle thereof, and said conductor clamp comprises a hooked portion fastened to the retaining hole.

4. The electric plug of claim 1 wherein one of said metal comprises two lugs parallel lugs integral with a middle part thereof, said lugs defining a space therebetween adapted to secure conductor means of the corresponding electric wire.

* * * * *